US005118306A

United States Patent [19]

Bixler et al.

[11] Patent Number: 5,118,306

[45] Date of Patent: Jun. 2, 1992

[54] MULTI-CONDUCTOR ELECTRICAL CONNECTOR

[75] Inventors: Craig Bixler, Elmhurst; Jerry A. Long, Elgin, both of Ill.

[73] Assignee: Molex Incorporated, Lisle, Ill.

[21] Appl. No.: 706,923

[22] Filed: May 29, 1991

[51] Int. Cl.[5] ..... H01R 4/24

[52] U.S. Cl. ..... 439/405; 439/610; 439/358

[58] Field of Search ..... 439/389-407, 439/417-419, 607-610, 901-906, 498, 351, 357, 358

[56] References Cited

U.S. PATENT DOCUMENTS

| | | | |
|---|---|---|---|
| 3,367,005 | 1/1983 | Douty et al. | 339/107 |
| 4,095,870 | 6/1978 | Mathe | 439/404 |
| 4,153,325 | 5/1979 | Asick | 339/96 |
| 4,209,219 | 6/1980 | Proietto | 439/405 |
| 4,327,956 | 5/1982 | Sitzler | 439/404 |
| 4,398,780 | 8/1983 | Novotny et al. | 439/906 |
| 4,619,493 | 10/1986 | Kikuta | 439/607 |
| 4,640,984 | 2/1987 | Kalbfeld | 174/135 |
| 4,668,039 | 4/1987 | Marzili | 339/99 |
| 4,671,596 | 6/1987 | Soma | 439/404 |
| 4,689,723 | 8/1987 | Myers et al. | 439/607 |
| 4,726,783 | 2/1988 | Nakazawa et al. | 439/350 |
| 4,770,646 | 9/1988 | Shimada | 439/395 |
| 4,822,303 | 4/1989 | Nakamura et al. | 439/607 |
| 4,854,890 | 8/1989 | Nishimura | 439/607 |
| 4,902,242 | 2/1990 | Davis et al. | 439/404 |
| 4,938,711 | 4/1990 | Davis et al. | 439/405 |
| 4,963,104 | 10/1990 | Dickie | 439/610 |

*Primary Examiner*—David L. Pirlot

*Attorney, Agent, or Firm*—A. A. Tirva; Charles S. Cohen

[57] ABSTRACT

An electrical connector assembly is provided for terminating a multi-conductor cable. The assembly includes a conductive guide member having a plurality of channels for positioning the conductors of the multi-conductor cable whereby the conductors can be trimmed along an edge of the guide member. A cover member is profiled for engagement with the conductor guide member, with a portion of the cover member covering exposed ends of the trimmed conductors. A base assembly mounts a plurality of terminals and is profiled for aligning the terminals for termination to respective conductors when the base assembly is assembled with the conductor guide member and cover member. The cover member is sandwiched between the conductive guide member and the base assembly and includes a plurality of apertures through which the terminals project for termination to the conductors. The connector includes a conductive backshell formed by a pair of backshell halves. The backshell halves provide strain relief for the cable, a clamping device for a drain wire from the cable and a ground connection for a shield of the base assembly. A mating connector is disclosed and includes a molded plastic housing and a metal shield for mating with the electrical connector assembly for the multi-conductor cable.

24 Claims, 13 Drawing Sheets

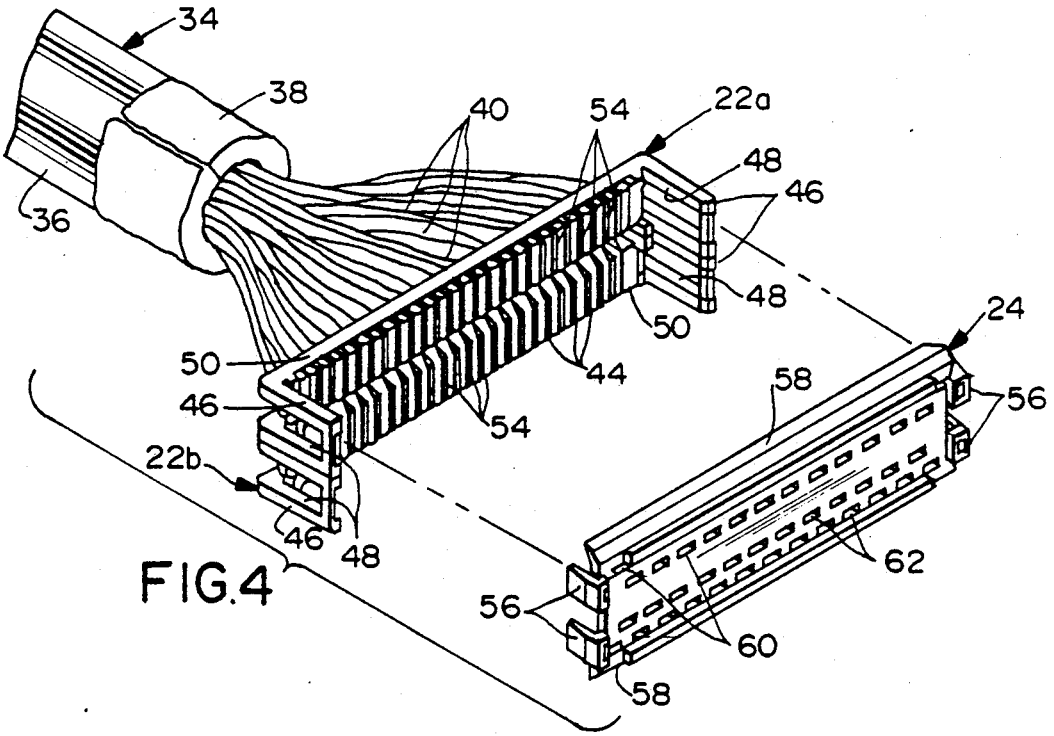
FIG.4
FIG.4A
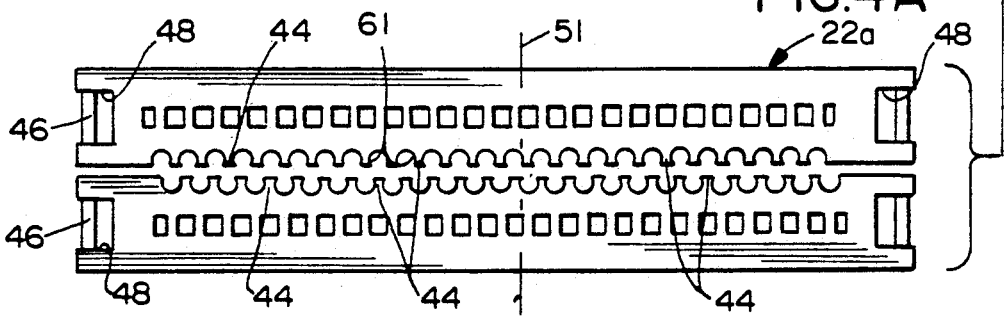
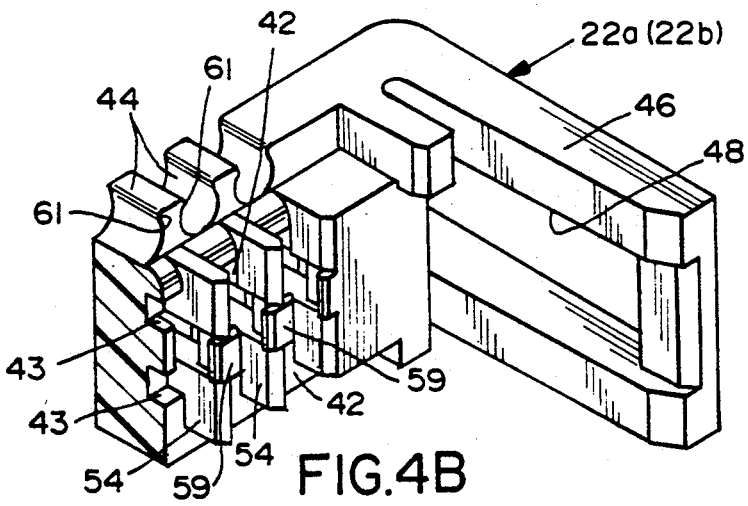
FIG.4B

MULTI-CONDUCTOR ELECTRICAL CONNECTOR

FIELD OF THE INVENTION

This invention generally relates to the art of electrical connectors and, particularly, to an electrical connector assembly for terminating a multi-conductor cable.

BACKGROUND OF THE INVENTION

Electrical connectors have been provided in a wide variety of configurations for terminating multi-conductor cables, both discrete wire cables and integral flat or ribbon cables. With the ever-increasing miniaturization of electrical connectors and the ever-increasing numbers of wires in multi-conductor cables, electrical connectors of the character described have become increasingly complicated in order to accommodate relatively large numbers of conductors terminated in relatively small connectors. This is particularly true when the multi-conductor cable is a shielded cable and, consequently, the electrical connector must have shielding capabilities, such as providing a shielding backshell for the conductors and shielding means for the terminals terminated to the conductors.

Because of the ever-increasing miniaturization of such electrical connectors, extraneous connector hardware for facilitating assembly of the connector components practically has been made prohibitive, and assembly of the connectors often must be accomplished by interengageable and complementarily configured connector components which are assembled together by elements or parts of the components themselves fitting together in a fixed relationship in final assembly. This becomes very difficult to accomplish and still provide desirable features in the connector, such as guide means for the discrete wires, trimming the wires or conductors to appropriate lengths, isolating exposed ends of the conductors, providing strain relief for the cable as well as the conductors, providing ground connections for drain wires in the cable, providing reliable connections between the shielding components of the connector and other features which would appear to be impossible to incorporate in a single, small connector for a large number of conductors and respective terminals.

This invention is directed to providing an electrical connector of the character described which provides all of the features listed above in a connector assembly which is easy to assemble and reliable in terminating the conductors to respective terminals.

SUMMARY OF THE INVENTION

An object, therefore, of the invention is to provide a new and improved electrical connector assembly for terminating a multi-conductor cable.

In one embodiment of the invention, the electrical connector assembly includes at least one conductor guide member having a plurality of channels for positioning the conductors of the multi-conductor cable whereby the conductors can be trimmed along an edge of the guide member. A cover member is profiled for engagement with the conductor guide member, with a portion of the cover member covering the exposed ends of the trimmed conductors. A base member mounts a plurality of terminals and is profiled for aligning the terminals for termination to respective conductors when the base member is assembled with the conductor guide member and cover member.

As disclosed herein, the cover member is sandwiched between the conductor guide member and the base member and includes a plurality of apertures through which the terminals project for termination to the conductors. The channels of the conductor guide member open on a mating face thereof, and the cover member has a complementary mating face for retaining the conductors in the open channels. The conductor guide member and the cover member, and the cover member and the base member, are provided with complementary interengaging latch means for facilitating assembly of those components without extraneous hardware.

In the preferred embodiment of the invention, a pair of the conductor guide members are provided in an elongated configuration with each member having a plurality of the conductor-positioning channels. The guide members are profiled such that the channels in one guide member are offset relative to the channels in the other guide member when the guide members are juxtaposed in their longitudinal direction. The pair of guide members have recess means defining a longitudinal slot therebetween, when the guide members are in longitudinal juxtaposition, for receiving discrete conductors of the multi-conductor cable in such a manner that the conductors can be positioned seriatim in alternating ones of the channels in the respective guide members on opposite sides of the longitudinal slot. Comb means project from at least one of the conductor guide members into the slot for locating the discrete conductors in alignment with the channels. A plurality of insulation displacement terminals are mounted on the base member, the terminals having pin portions projecting outwardly in a row transverse to the conductors and insulation displacement portions projecting inwardly for termination to the conductors. The insulation displacement portions of alternating ones of the terminals are offset from a plane defined by the row of pin portions.

The invention contemplates a shielded electrical connector wherein the base member which mounts the terminals is in the form of a dielectric housing mounting the terminals. A metal shield is positioned about at least a portion of the dielectric housing. Latch means are provided between the housing and the shield. The latch means include at least one aperture in the shield and a latch projection on the housing for latching in the aperture. The aperture has at least one abrupt edge projecting outwardly from the shield. A conductive backshell is positioned about at least a portion of the shield which includes the latch means. The backshell is profiled to engage the abrupt edge of the aperture to enhance conductivity between the shield and the backshell. In the preferred embodiment of the invention, the shield is fabricated of stamped and formed metal material with the aperture being stamped and the abrupt edge being formed by a sharp distal edge of a cantilevered spring finger formed from the metal at one side of the aperture. As disclosed herein, a plurality of apertures are formed in the shield, and a pair of the spring fingers are formed at opposite sides of the aperture and defining abrupt edges for engaging the conductive backshell.

Another feature of the invention is the provision of means for grounding a drain conductor of the multi-conductor cable. Specifically, the backshell is formed of a pair of mating halves. One half includes a groove for receiving the drain conductor and the other half has a rib for forcing the drain conductor securely into the groove when the halves are mated. Consequently, again no extraneous hardware is required to ground the drain conductor to the conductive backshell.

A further feature of the invention is the provision of strain relief means for the multi-conductor cable. More particularly, one of the backshell halves has at least a pair of integral ribs for clamping onto one side of the cable, and the other backshell half has at least one rib for clamping onto an opposite side of the cable, the one rib being located between the pair of ribs when the backshell halves are assembled.

Another feature of the invention is the provision of lock means on the backshell for engaging an appropriate mating connector. Specifically, the lock means include a locking member of elastic material having a proximal end engaging the backshell, a distal end for locking engagement with the mating connector and a fulcrum portion intermediate the ends. The fulcrum portion is generally cylindrical and the backshell has a generally rounded socket formed by cylindrical walls within which the fulcrum portion of the lock means is disposed.

The invention contemplates that the dielectric housing of the terminal-mounting base member can be fabricated of molded plastic material. Latch means are provided between the plastic housing and the shield. The latch means include at least one latch arm molded integral and projecting from the plastic housing, with a hook-shaped portion for snapping into an aperture in the shield which is fabricated of stamped and formed metal material.

Lastly, a ground clip is provided on the plastic housing, engaging the shield, and having a boardlock to secure the entire electrical connector assembly to a printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

FIG. 4 is a perspective view illustrating the conductors being trimmed, in conjunction with the cover member of the connector assembly;

FIG. 4A is a rear elevation view of the pair of guide members, illustrating the offset nature of the conductor-receiving means of the members;

FIG. 4B is a fragmented perspective view of the inside of one of the guide members to show the conductor-receiving channels thereof;

DETAILED DESCRIPTION OF THE PREFERRED EMBODIMENT

Figure 1:
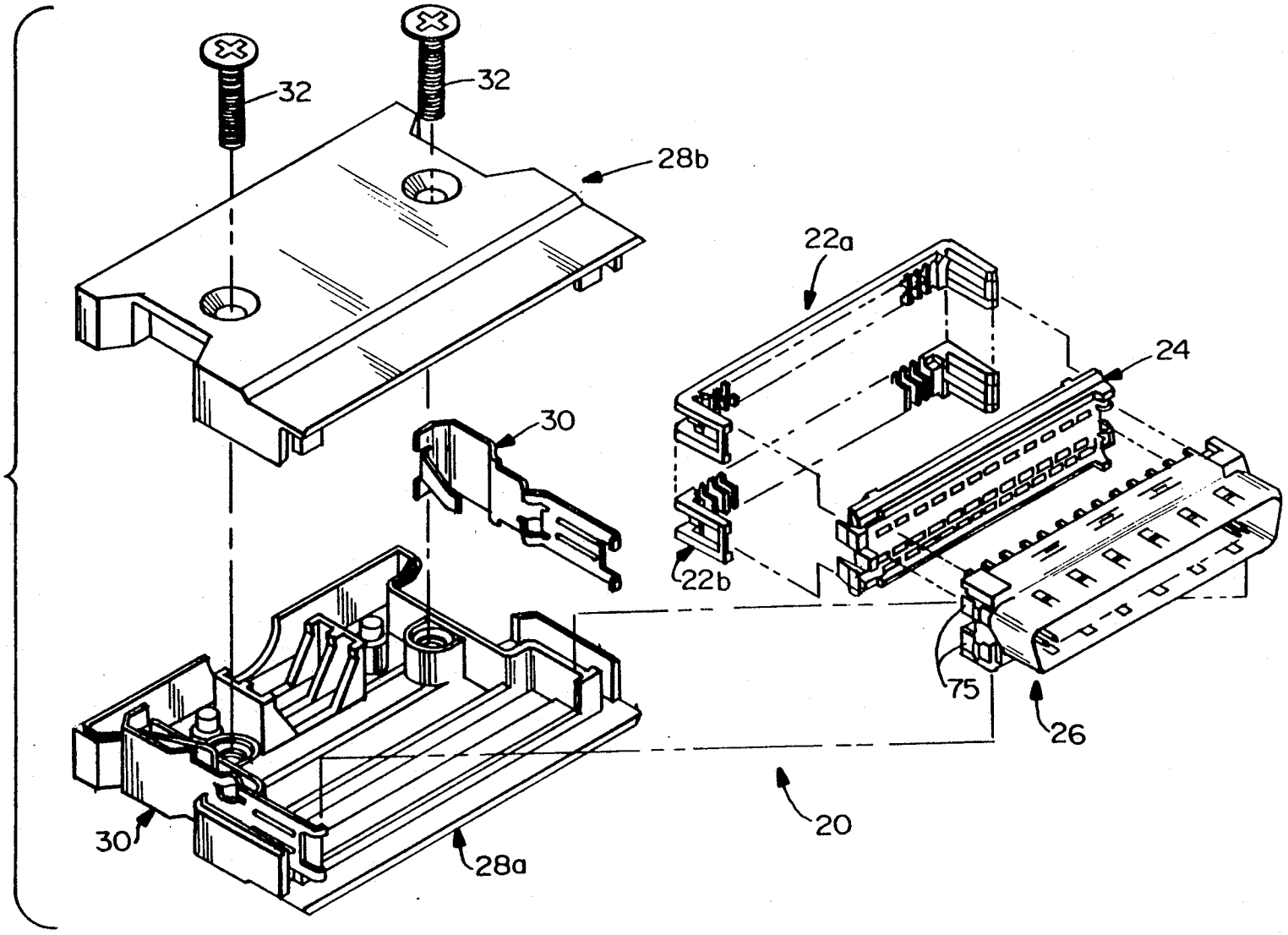
FIG. 1 is an exploded perspective view of the major components of the electrical connector assembly of the invention.

Referring to the drawings in greater detail, and first to FIG. 1, the basic components of an electrical connector assembly, generally designated 20, are shown in an exploded depiction. The basic components include a pair of conductor guide members, generally designated 22*a* and 22*b*; a cover member, generally designated 24; a terminal mounting base assembly in the form of an electrical connector plug assembly, generally designated 26; a backshell assembly including a lower half, generally designated 28*a*, and an upper half, generally designated 28*b*; a pair of elastic latches, generally designated 30, for mounting between backshell halves 28*a* and 28*b* and for engaging a complementary connector (illustrated hereinafter); and a pair of screws 32 for assembling backshell halves 28*a* and 28*b* with the other basic components mounted therewithin.

Figure 2:
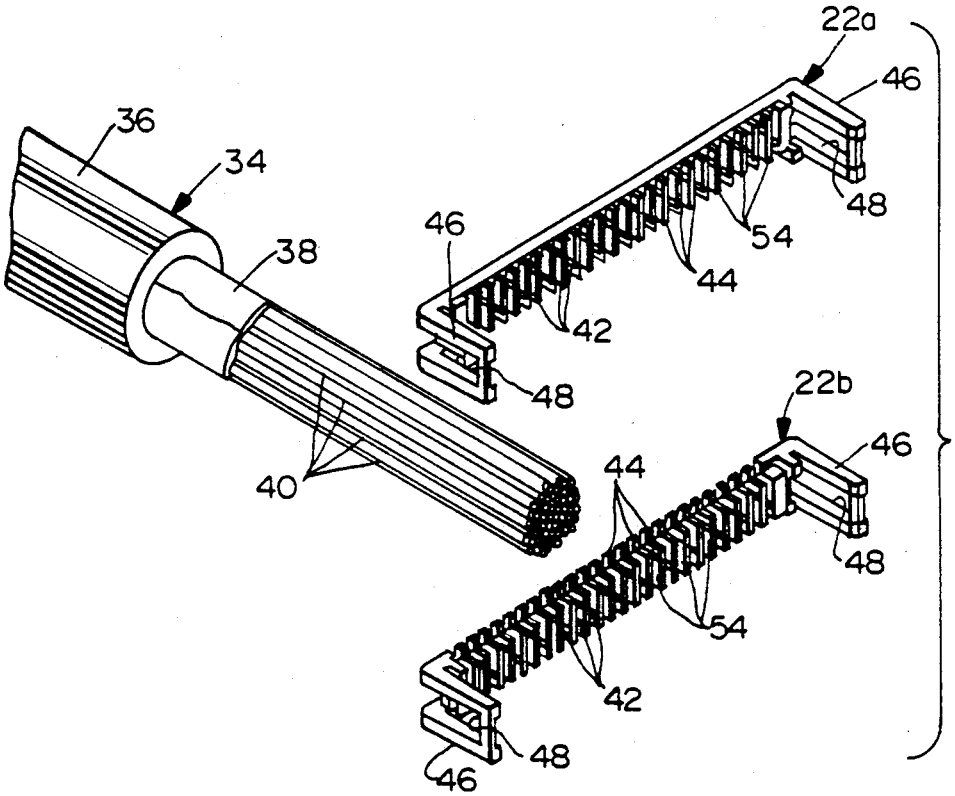
FIG. 2 is an exploded perspective view of a multi-conductor cable having discrete wires in conjunction with the conductor guide members of the connector assembly.

FIGS. 2–4 and 6–9 illustrate the manner in which electrical connector assembly 20 (FIG. 1) is assembled to a multi-conductor cable. More particularly, referring first to FIG. 2, a multi-conductor cable, generally designated 34, includes an outer jacket 36, an interior braided and/or foil shield 38 and a plurality of discrete, insulation-cladded conductors 40. Normally, the conductors are color-coded according to a prescribed circuit profile. Conductor guide members 22*a* and 22*b* also are shown in FIG. 2. Each guide member has a plurality of channels 42, defined by a plurality of parallel ribs 54, for receiving and positioning conductors 40 according to the circuit profile. It can be seen by guide member 22*b* that both guide members 22*a* and 22*b* have a plurality of projections 44 projecting toward the other guide member for purposes described hereinafter. Latch arms 46, having slots 48, are provided at each opposite end of each guide member 22*a* and 22*b*.

Figure 3:
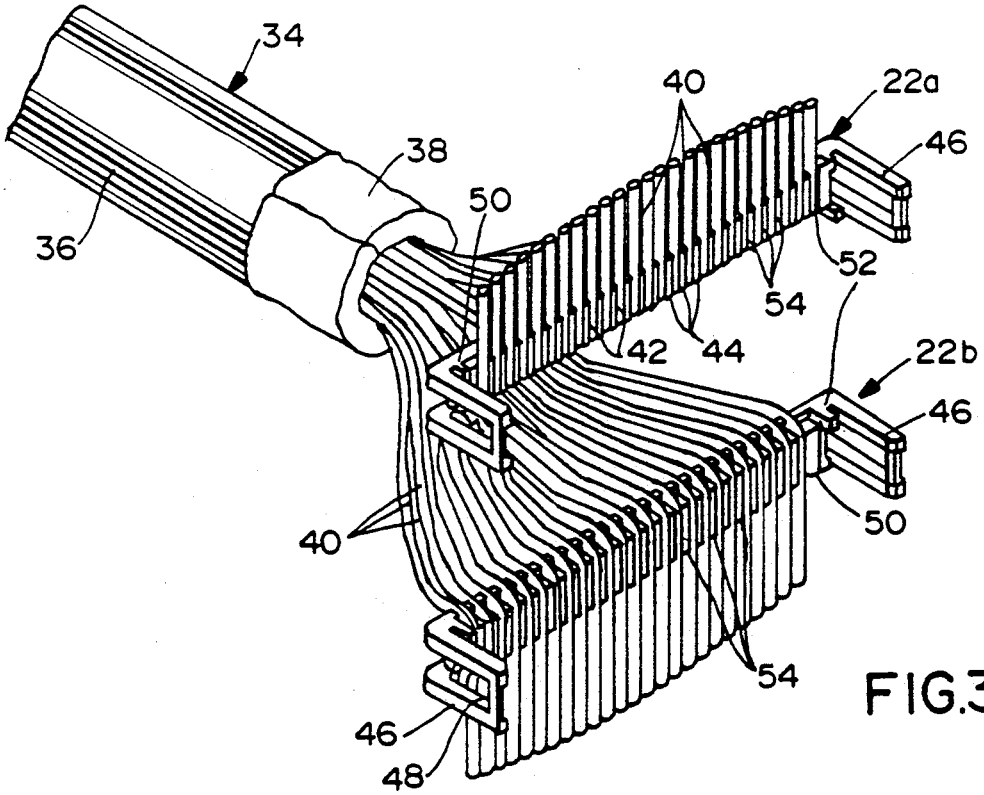
FIG. 3 is a perspective view illustrating the discrete wires of the multi-conductor cable sorted and positioned in the channels of the guide members.

Referring to FIG. 3 in conjunction with FIG. 2, it can be seen that the discrete wires or conductors 40 have been sorted according to the circuit profile and positioned within channels 42 of guide members 22*a* and 22*b*. It also can be seen that the ends of conductors 40 project beyond a longitudinal edge 50 of each elongated guide member. These edges provide a reference surface along which the ends of the conductors can be trimmed. It also can be seen by the lower guide member 22*b*, how the discrete wires are positioned in channels 42 between projections 44 of the guide members. Actually, it can be understood that the guide members are provided with slots in their facing edges 52, with projections 44 protruding in the slots to separate the discrete conductors. In addition, channels 42 actually are formed by ribs 54 (FIG. 4B) formed integrally with the guide members. In order to hold the discrete wires in the channels and between projections 44, the ribs 54 and the projections 44 include wire retaining portions 59 and 61 that enclose the wire receiving channels 42 and 45, respectively, so that the conductors "snap" into their respective positions. Projections 44 and ribs 54 form a "comb" between the guide members for, sorting positioning and separating the conductors. In order to provide guide members 22*a* and 22*b* with all of the features described above, preferably the guide members are molded integrally of dielectric material, such as plastic or the like.

Referring to FIG. 4 in conjunction with FIG. 3, it can be seen that the discrete conductors have been trimmed along edges 50 of guide members 22*a* and 22*b*. In addition, the guide members have been moved into longitudinal juxtaposition. Cover member 24 is profiled for engagement with the guide members and for covering the exposed ends of the trimmed conductors. More particularly, cover member 24 is integrally molded of dielectric material, such as plastic or the like, and includes a pair of snap-latch arms 56 at each opposite end thereof for positioning into slots 48 of the latch arms 46 of the juxtaposed guide members. The cover member includes upper and lower flanges 58 which cover the exposed ends of the trimmed conductors, as will be seen hereinafter. In addition, the cover member has a plurality of through-holes or apertures through which insulation-displacement terminals on base assembly 26 (FIG. 1) are inserted for insulation-displacement termination with the trimmed ends of conductors 40.

Figure 10:
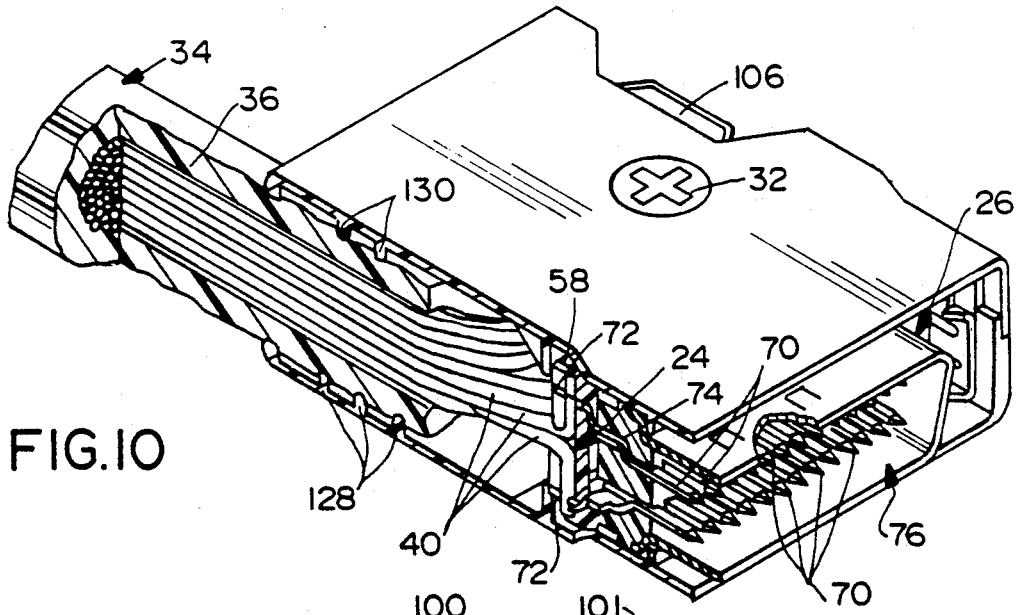
FIG. 10 is a vertical section, on an enlarged scale, taken generally along line 10—10 of FIG. 9.
Figure 22:
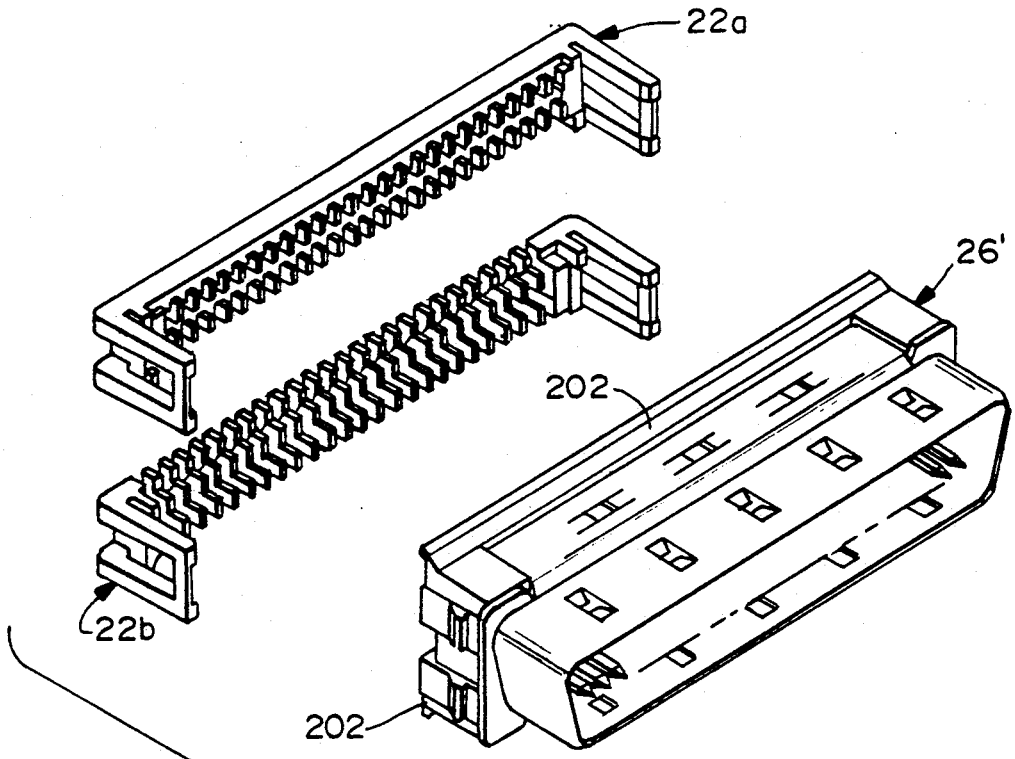
FIG. 22 is an alternate embodiment of the invention wherein the cover member of the wire management system is eliminated.
Figure 23:
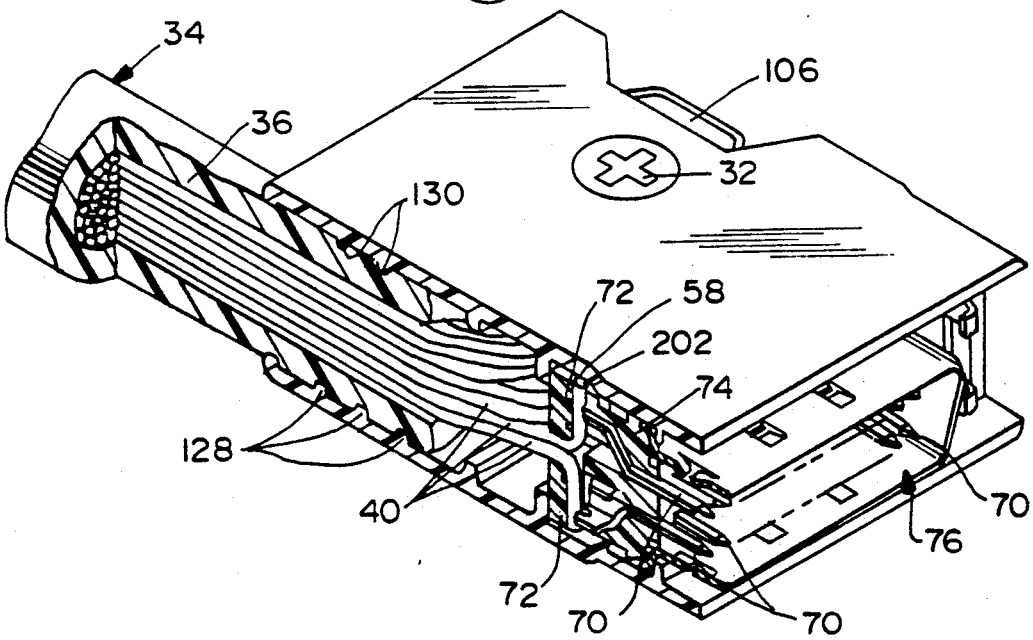
FIG. 23 is a vertical section identical to FIG. 10 except that the cover member is eliminated.

In the preferred embodiment, cover 24 is eliminated as shown in FIGS. 10 and 22. In this embodiment, a base assembly 26 is provided with upper and lower flanges 202 which correspond in function to upper and lower flanges 58 of cover member 24. In other words, flanges 202 of base or plug assembly 26 cover and insulate the exposed trimmed ends of the conductors. Otherwise, the structure is not changed. The assembled connector without the cover 24 is shown in FIG. 23.

At this point, it should be noted that the electrical connector assembly of this invention is designed for terminating a large number of conductors. To this end, and referring to FIG. 4A, it can be seen that sorting projections 44 of one guide member 22*a* are offset relative to the projections of the other guide member 22*b*. Of course, the notches between the projections are aligned with the conductor-receiving channels of the respective guide members. This offsetting of the conductor-receiving means is accomplished in a unique manner which saves considerable tooling, manufacturing and inventory costs. Specifically, guide members 22*a* and 22*b* are identical components which are hermaphroditic in that projections 44 and ribs 54 are offset longitudinally from the longitudinal centerline 51 (FIG. 4A) of the guide members by one quarter of the distance between the projections (i.e., the pitch). As a result, when the guide members are juxtaposed in opposing relationship as shown in FIG. 4A, the projections of 44 one guide member are offset ½ pitch relative to the projections 44 of the other guide member.

The savings in tooling, manufacturing and inventory costs in fabricating guide members 22*a* and 22*b* as identical components, as described immediately above, can be appreciated by referring to FIG. 4B which shows a portion of the terminating side of one of the guide members 22*a* (22*b*) and the intricate details thereof. Projections 44 are shown at the top of the guide member, along with ribs 54 which define conductor-receiving channels 42. In addition, each rib 54 has an integrally molded flange 59 which projects to opposite sides of the rib, into the adjacent channels, to retain the conductors in the channels. Being able to mold a single structure in such a miniature connector, with such intricacies, saves considerable tooling costs when the guide member component is hermaphroditic as described in relation to FIG. 4A.

Each channel 42 includes upper and lower receptacles 43 into which the end of the insulation displacement portion 72 of terminal 100 (FIG. 11) can project after the terminals are terminated to the wires. In practice, the end of a terminal will project into only one of the receptacles in each channel.

Figure 11:
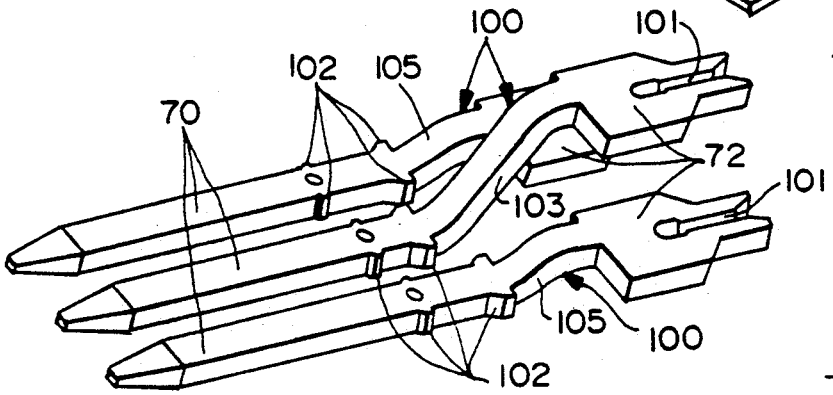
FIG. 11 is a perspective view, on an enlarged scale, of the terminals mounted in the base member of the connector shown in FIGS. 1-10.
Figure 25:
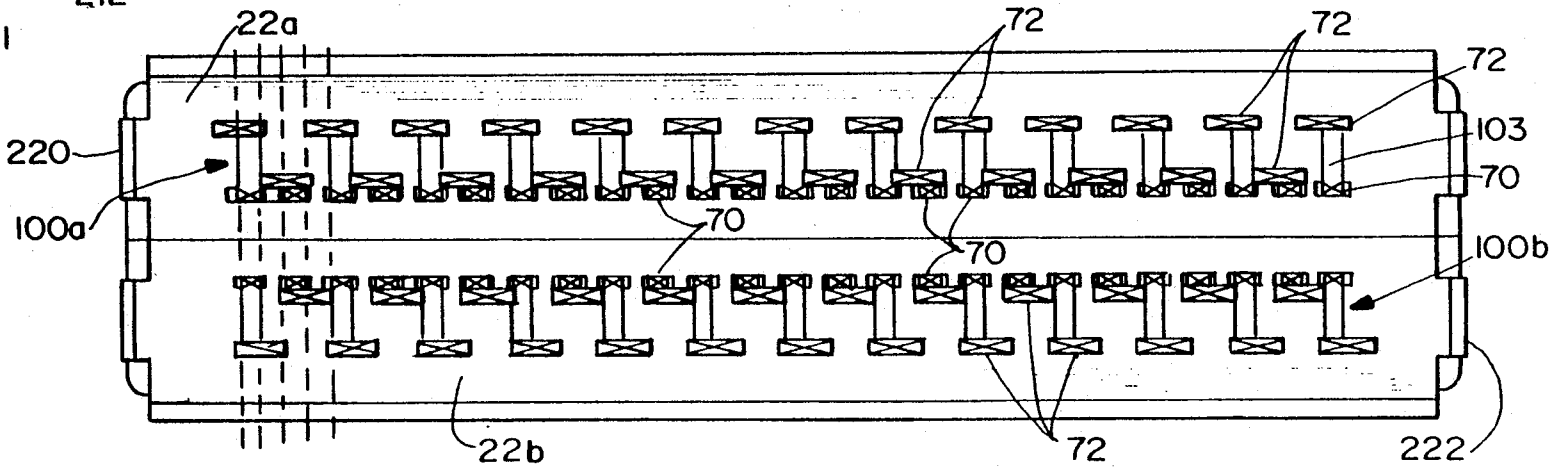
FIG. 25 is a somewhat schematic view of the pin terminal configuration of a connector having fifty pin terminals.
Figure 26:
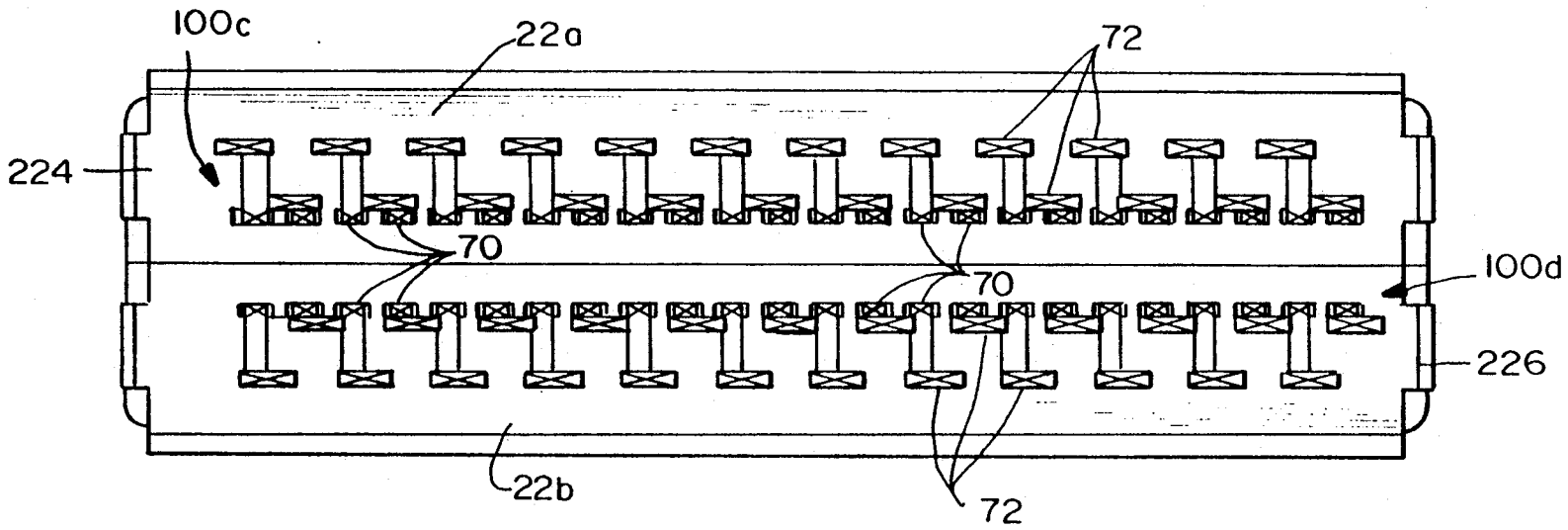
FIG. 26 is a somewhat schematic view similar to that of FIG. 25 except that the connector has 48 pin terminals.

As shown in FIGS. 11, 25 and 26 male terminals 100 are formed so that the insulation displacement portion 72 is offset from pin portion 70. The amount of offset alternates through the use of long offset legs 103 and short offset legs 105. This offset becomes particularly significant when the number of terminals 100 in each row (FIGS. 9, 10 and 23) change from an even number to an odd number. Although connectors utilizing two rows of thirty four pins are common as are connectors having two rows of twenty five pins, FIGS. 25 and 26 show connectors having two rows of twenty five and twenty four pins, respectively, in order to simplify the comparison of rows having an even or odd number of pins.

FIG. 25 shows the pin portions 70 of terminals 100 as well as the insulation displacement portions 72 which are alternately offset due to the length of offset legs 103 and 105. In the configuration in which the rows have an odd number of terminals, it can be seen that the configuration of the terminals terminated to the set of wires in upper guide member 22*a* is identical to that of the terminals terminated to the set of wires in lower guide member 22*b* except that the lower terminals as a group have been rotated 180°. For example, the terminal 100*a* closest to the left outer edge 220 (as viewed in FIG. 25) of upper guide 22*a* has a long offset leg 103. When the upper guide 22*a* is rotated 180° and juxtaposed in opposing relationship to lower guide 22*b*, it can be seen that the pin terminal 100*b* closest to the right outer edge 222 (as viewed in FIG. 25) of lower guide 22*b* also has a long offset leg 103. In fact, the configuration of the terminals associated with upper guide 22*a* is identical to that of the terminals associated with the lower guide except it is rotated 180°. When the rows of terminals include an odd number of terminals, only one receptacle 43 (FIG. 4B) is required for each channel 42 because the lower guide member 22*b* and its associated terminals are maintained in the same relationship as the upper guide member 22*a* and its associated terminals but the entire subassembly is rotated 180°.

When the number of pins in a row is an even number as shown in FIG. 26, the relationship between the upper guide member 22*a* and its terminals is not maintained when compared to the lower guide member 22*b* and its terminals. Each of the long offset legged terminals is replaced by short offset legged terminals and each of the short offset legged terminals is replaced by the long offset legged terminals. For example, the pin terminal 100*c* closest to the left outer edge 224 (as viewed in FIG. 26) of upper guide 22*a* has a long offset leg 103. The pin terminal 100*d* closest to the right outer edge 226 (as viewed in FIG. 26) however, has a short leg 105. Accordingly, the relationship between the upper set of terminals and the upper guide 22*a* is not the same as the relationship between the lower terminals and the lower guide 22*b*. Thus, the provision of both upper and lower receptacles 43 provides the flexibility to easily change the number of circuits carried by the hermaphroditic guide members 22*a* and 22*b*without significant changes to the molds used to form the guide members.

Still further, cover member 24 has two upper rows of apertures 60 and two lower rows of apertures 62. The apertures in the two upper rows 60 are offset relative to each other, and the apertures of the two lower rows 62 are offset relative to each other. The offset apertures 60 in the upper two rows consequently are in alternating alignment with the conductors positioned by upper guide member 22*a*, and the offset apertures in the lower two rows 62 are in alternating alignment with the conductors positioned by lower guide member 22*b*. By providing these offsets, fairly substantial insulation-displacement terminals can be provided to exert sufficient insulation-displacement forces notwithstanding the relatively short longitudinal dimensions of the connector components and the relatively large number of conductors. In fact, it can be seen in FIG. 4 that fifty conductors are accommodated by the relatively small connector.

Figure 5:
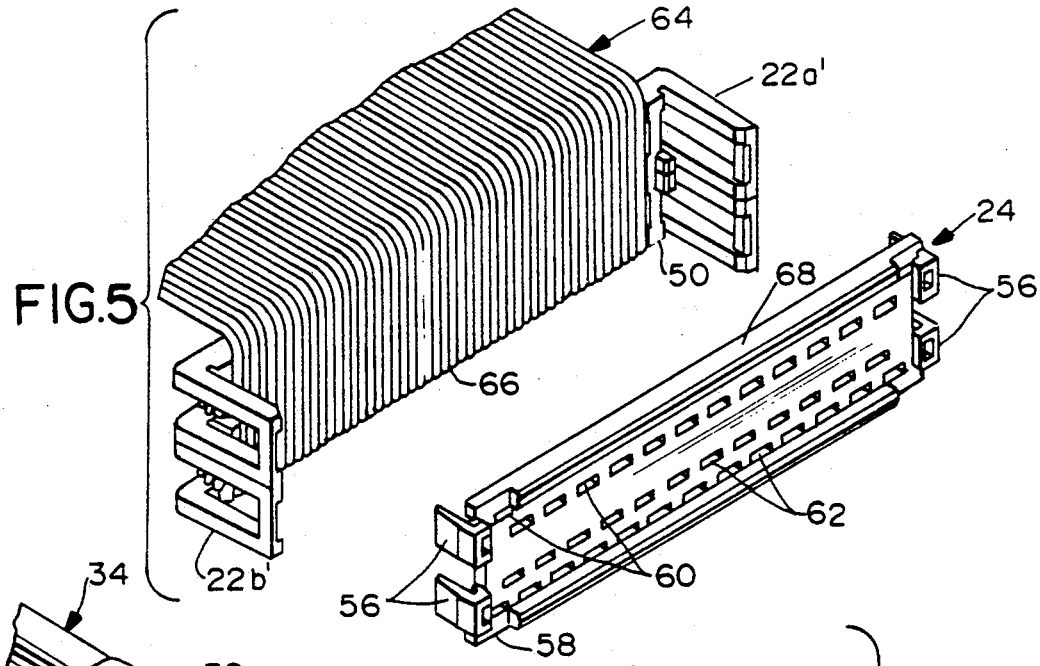
FIG. 5 is a similar to that of FIG. 4. but the multi-conductor cable is illustrated as a flat or ribbon cable.

FIG. 5 is a view similar to that of FIG. 4, but illustrates how a pair of guide members 22*a'* and 22*b'* similar to guide members 22*a* and 22*b* can be used for positioning a multi-conductor flat or ribbon cable, generally designated 64; and how a cover member generally designated 24', can be used in conjunction with guide members 22*a'* and 22*b'* and the ribbon cable. With the ribbon cable, the cable is not inserted between the guide members, and the conductors of the cable are trimmed only along one edge, as at 66, of the juxtaposed guide members i.e., edge 50 of guide member 22*b'*. In addition, it can be seen that the top 68 of cover member 24' is not provided with a flange, as with flange 58 at the top of cover member 24 shown in FIG. 4. Only one flange 58, at the bottom of cover member 24' is required to cover and isolate the trimmed ends of the conductors of ribbon cable 64. Otherwise, guide members 22*a'* and 22*b'*, as well as cover member 24', are substantially identical to guide members 22*a* and 22*b* and cover member 24 shown in FIG. 4. In addition to the connector assembly components being capable of use with ribbon cable, the design of the connector assembly is readily applicable in a "daisy chain" (a "go-through" connection) by modifying cover member 24' to also remove the bottom flange 58.

Figure 6:
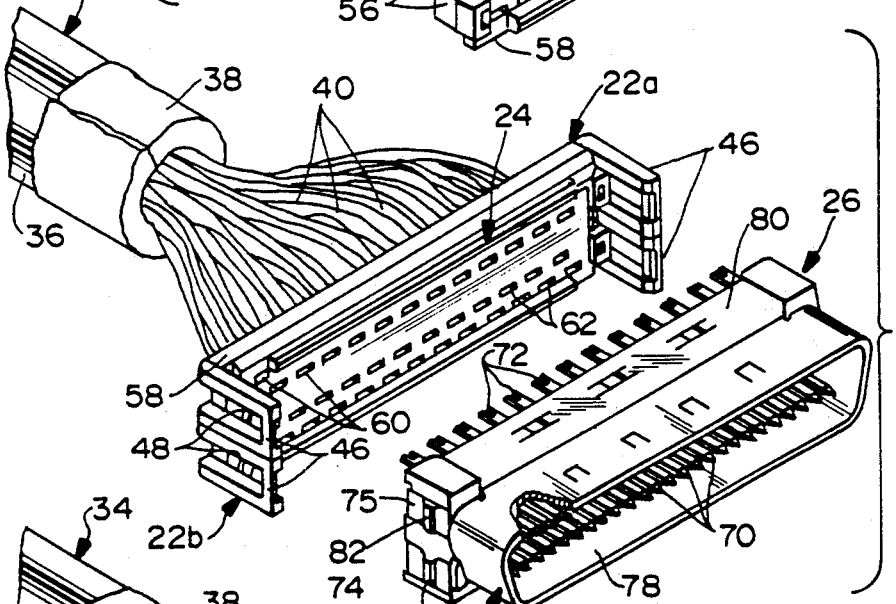
FIG. 6 is a perspective view of the cover member assembled to the guide member, in conjunction with the terminal mounting base assembly of the connector assembly.

Turning now to FIG. 6 in conjunction with FIG. 4, it can be seen that cover member 24 has been moved into position between latch arms 46 of the longitudinally juxtaposed guide members 22*a* and 22*b*. In this position, upper and lower flanges 58 of the cover member cover and isolate the exposed trimmed ends of conductors 40. Therefore, the exposed trimmed ends are protected and insulated so they cannot be engaged by any other components of the connector assembly, such as conductive shield halves 28*a* and 28*b* (FIG. 1). Further, the cover holds the guide members 22*a* and 22*b* together, guides the insulation displacement portions 72 of the terminals during termination and provides additional security for maintaining the wires. FIG. 6 also shows base or plug assembly 26 in position about to be assembled to the sub-assembly of guide members 22*a* and 22*b* and cover member 24. As will be seen in greater detail, base assembly 26 mounts a plurality of terminals having pin portions 70 projecting outwardly in two rows transverse to the array of trimmed conductors 40 for mating with terminals of a complementary connector (described hereinafter), and insulation displacement portions 72 projecting inwardly for insulation-displacement termination with the trimmed ends of the conductors. The terminals are located within base assembly 26 for alignment with the offset apertures in rows 60 and 62 of apertures in cover member 24.

Base assembly 26 includes a dielectric housing 74, integrally molded such as of plastic material, and a shield, generally designated 76, mounted on the housing. The shield includes a "D-shaped" hood portion 78 surrounding pin portions 70 of the terminals, and rearwardly projecting upper and lower flange portions 80 over a substantial portion of housing 74. Each opposite end of housing 74 is provided with a pair of rectangular projections 75 with latch detents 82 thereon for snapping into slots 48 in latch arms 46 of guide members 22*a* and 22*b*. The rectangular projections 75 are dimensioned to be received within slots 48 in order to ensure proper locating of guide members 22*a* and 22*b* on housing 74. This can be seen in FIG. 7 wherein base assembly 26 is shown fully assembled to the sub-assembly of guide members 22*a* and 22*b* and cover member 24.

Figure 7:
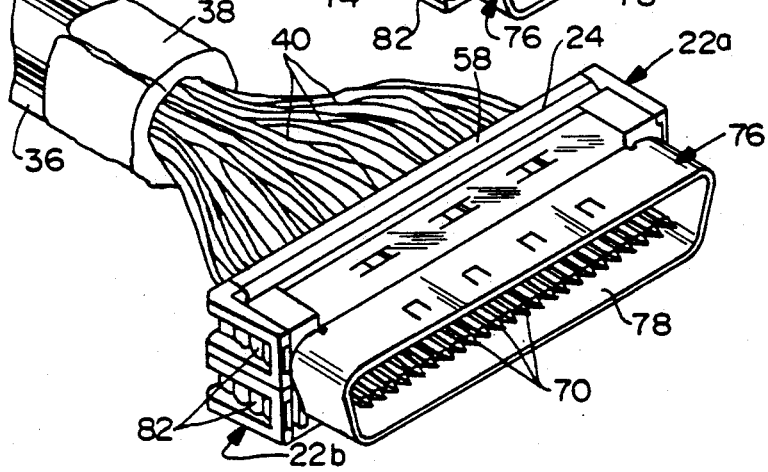
FIG. 7 is a view similar to that of FIG. 6, with the base assembly assembled to the guide members and cover member and terminating the conductors of the multi-conductor cable.
Figure 8:
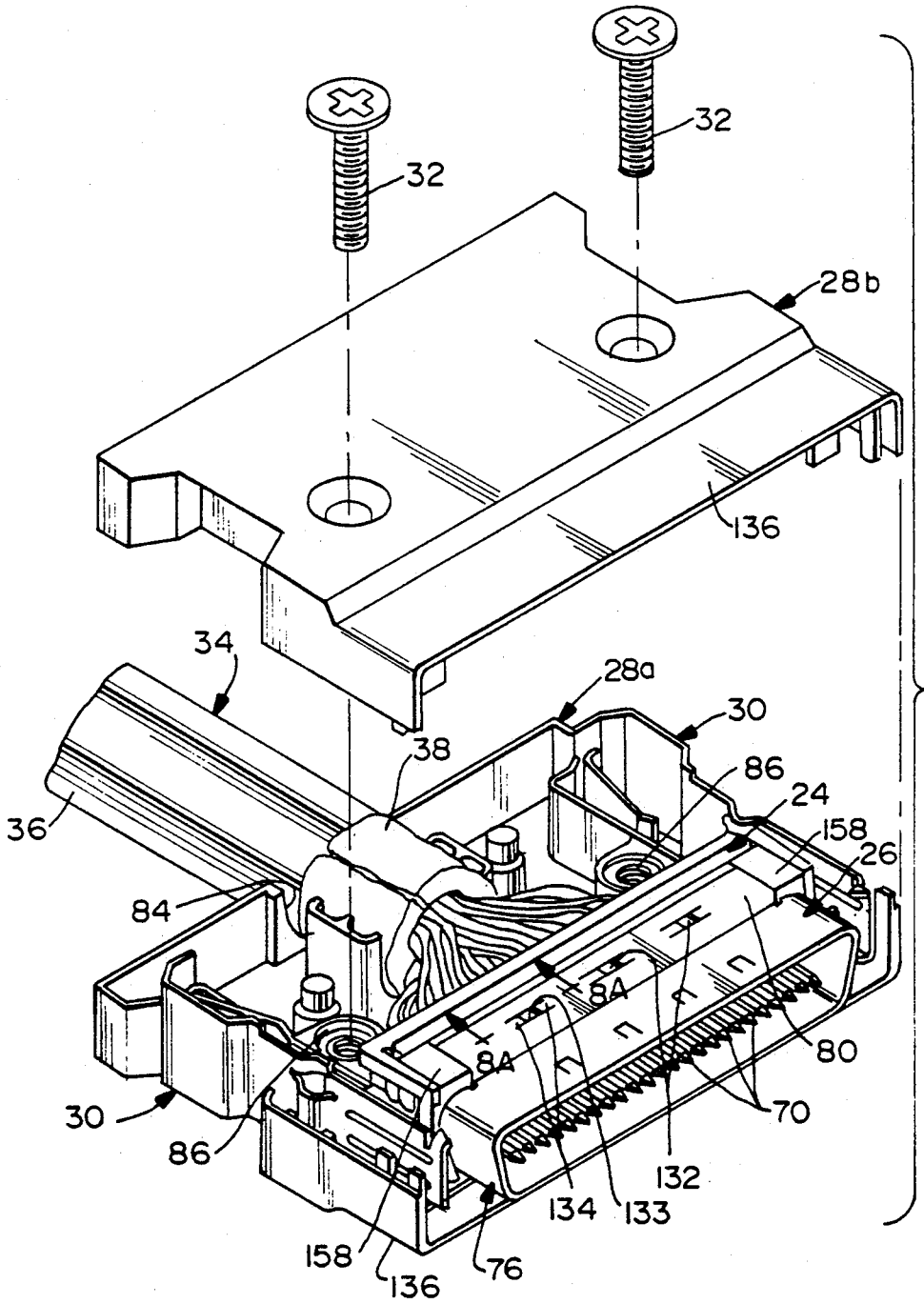
FIG. 8 is a perspective view of the subassembly of FIG. 7 mounted in the lower half of a backshell assembly of the connector assembly, the upper half of the backshell about to be assembled thereto.
Figure 9:
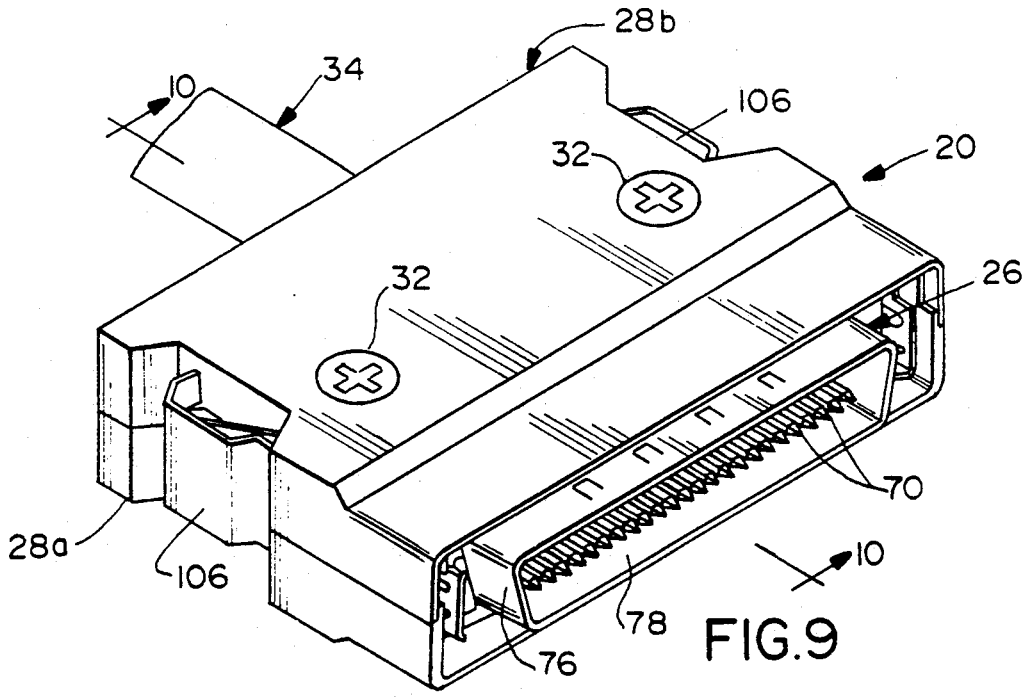
FIG. 9 is a perspective view of the completely assembled connector incorporating all of the components of FIG. 1.

Referring to FIG. 8 in conjunction with FIG. 7, it can be seen that the sub-assembly shown in FIG. 7, including base assembly 24, is positioned in lower conductive backshell half 28*a*, with upper backshell half 28*b* in position for assembly with the lower backshell half by screws 32. The lower backshell half includes a semi-circular recess 84 (FIG. 12) for receiving multi-conductor cable 34. FIG. 9 shows upper backshell half 28*b* assembled to lower backshell half 28*a*, with hood portion 78 of shield 76 of base assembly 26 projecting forwardly for mating with a complementary connector. Screws 32 are used for threading into internally threaded bosses 86 (FIG. 8) of lower backshell half 28*a*. When fully assembled, and as seen in FIG. 10, insulation displacement portions 72 of the terminals are terminated to discrete conductors 40 of multi-conductor cable 34 in a manner known in the art.

FIG. 11 shows an enlarged depiction of three of the terminals, generally designated 100, mounted in one row within dielectric housing 74 of base assembly 26 as seen in best in FIG. 10. As described in relation to FIG. 4, the insulation displacement portions 72 in each of two rows of terminals 100 are positionable through the two rows 60 and 62 of two offset rows of the apertures in cover member 24. Consequently, it can be seen in FIG. 11 that the insulation displacement portions 72 of terminals 100 in each row thereof are offset vertically (as viewed in the drawings). In this manner, the insulation displacement portions 72 can be fabricated of substantial material in order to apply substantial insulation displacement forces in terminating insulation cladded conductors 40. In addition, insulation displacement slot 101 is horizontally offset relative to the axis of pin portion 70 of the terminals 100. As a result, only two different shaped terminals are required for the entire connector 20. Lastly, it can be seen that each terminal 100 has barbs 102 for securing the terminals within molded dielectric housing 74 of base assembly 26 as best seen in FIG. 10.

Referring to FIGS. 1, 12–15 and 15A, lock means 30 (FIG. 1) on lower backshell half 28*a* are shown in greater detail. More particularly, each lock means or locking member 30 includes a stamped and formed locking member of elastic material, such as metal, having a distal end 104 and a proximal end 106. The distal end has a pair of inwardly projecting hooks 108 for engaging behind a pair of outwardly projecting hooks 110 (FIGS. 18 and 19) on the ends of a pair of latch arms 112 molded integrally with housing 90 of mating connector 88. Proximal end 106 of each locking member 30 has a spring finger 114 for engaging a wall 116 of lower backshell half 28*a*. A fulcrum portion, generally designated 118, is formed between distal and proximal ends 104 and 106, respectively, of each locking member 30. The fulcrum portion is formed by three semi-cylindrical bends 120*a–c* in each stamped and formed locking member. The upper and lower bends project in the same direction while the center bend projects in the opposite direction. The semi-cylindrical portions combine to define a cylindrical fulcrum transverse to the longitudinal direction of each locking member.

Figure 15:
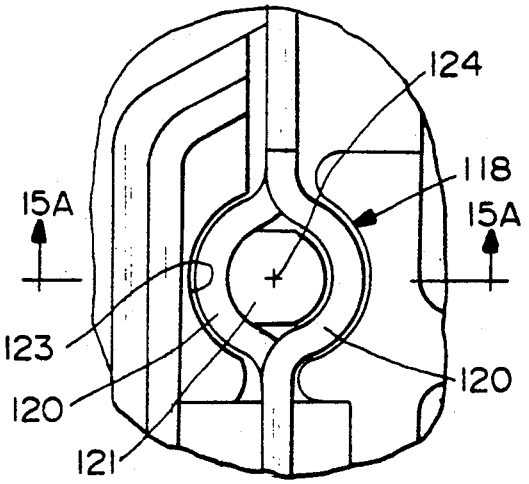
FIG. 15 is a fragmented plan view of the mounting means for the latch means shown in FIGS. 13 and 14.
Figure 15A:
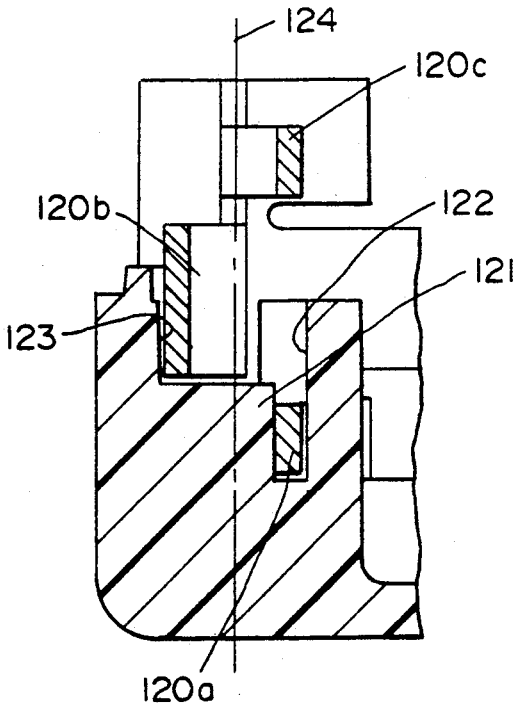
FIG. 15A is a Vertical section taken generally along line 15A—15A of FIG. 15.

The backshell halves are fabricated of die-cast conductive material and each includes a central semi-circular raised portion 121 and an outer semi-circular portion 122 which combine to define a rounded or cylindrical socket within which the upper and lower bends 120*a* and *c* are disposed when the halves are assembled whereby the locking member can pivot about an axis 124 (FIGS. 15 and 15A). The lower half 28*a* includes a second semi-circular raised portion 123 that guides the outer portion of center bend 120*b*. The upper half 28*b* includes central semi-circular raised portion and an outer semi-circular portion identical to those of lower half 28*a* which act to support upper bend 120*c*. The upper half also includes a second inner semi-circular raised portion (not shown) that combines with portion 123 to create a semi-circular slot in which center bend 120*b* is disposed. Because each of the bends 120*a–c* is supported on both its inner and outer surfaces in semi-circular slots, rocking of the lock means 30 is minimized. Therefore the latching between the two connector assemblies is more secure and less prone to accidental unlatching.

Figure 12:
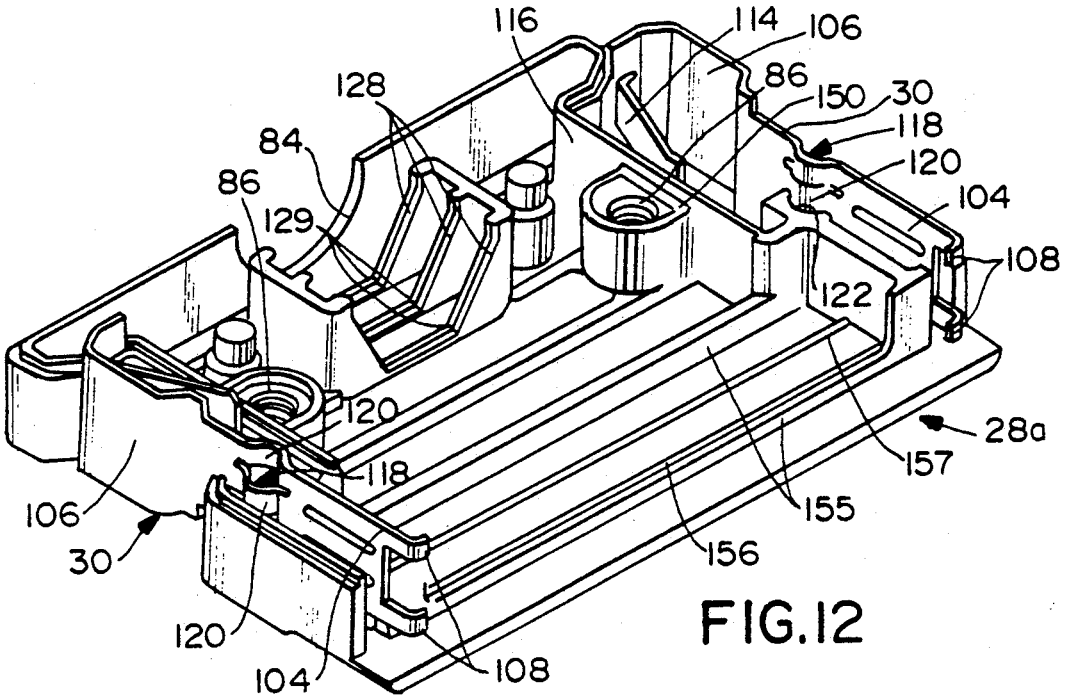
FIG. 12 is a perspective view of the bottom half of the backshell assembly, isolated from the assembly shown in FIG. 8.
Figure 13:
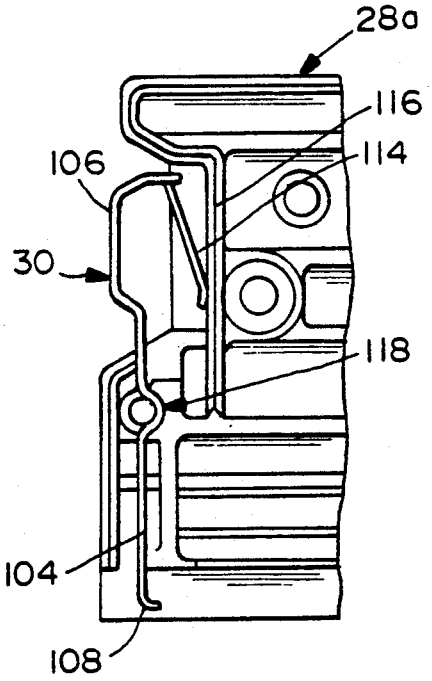
FIG. 13 is a fragmented top plan view of the left-hand end of the backshell half shown in FIG. 12, illustrating the latch means for the complementary connector.
Figure 14:
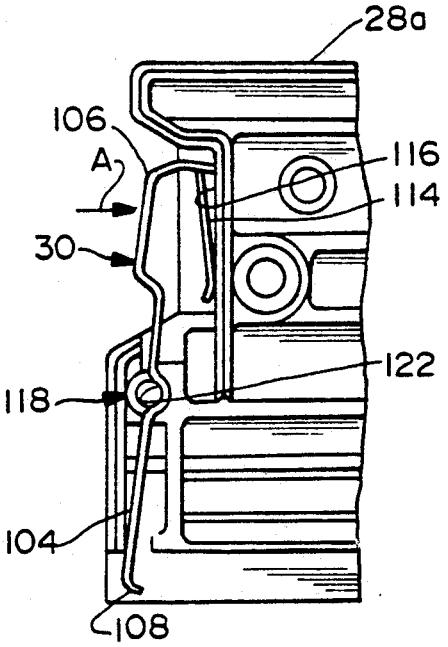
FIG. 14 is a view similar to that of FIG. 13, with the latch means in its open condition.
Figure 19:
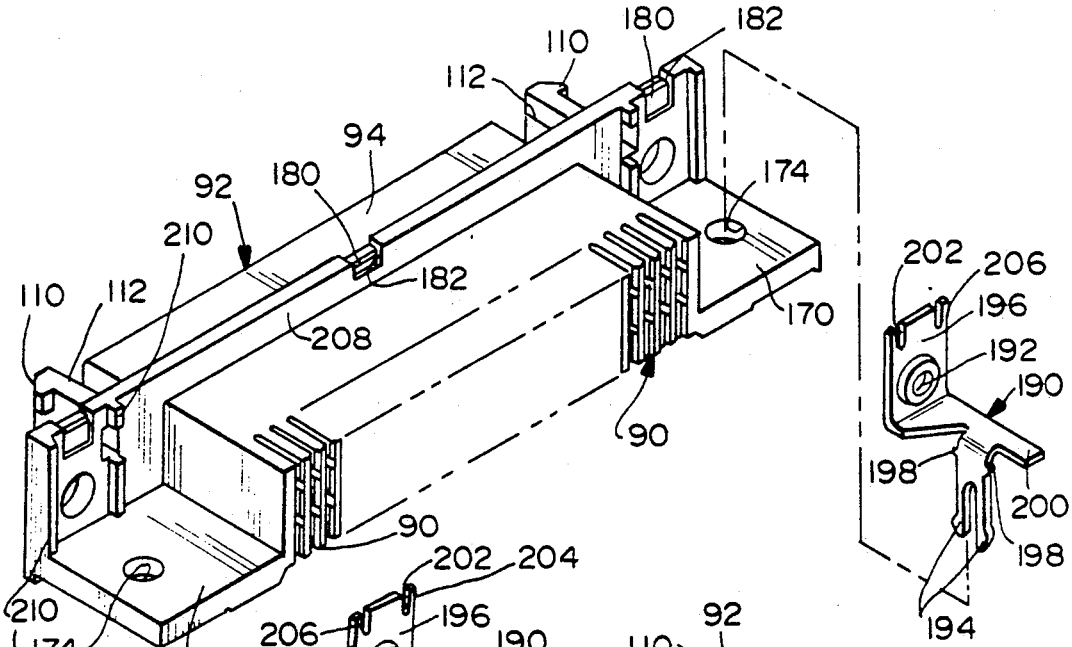
FIG. 19 is an exploded perspective view of the housing and ground clips of the complementary connector.

FIG. 13 shows the left-hand locking member 30 (as viewed in FIG. 12) in a latching position, and FIG. 14 shows the locking member in an open condition for receiving mating connector 88 (FIG. 19). It can be seen in FIG. 9 that proximal ends 106 of the locking members are exposed exteriorly of the connector assembly. By depressing the proximal ends inwardly, as in the direction of arrow "A" (FIG. 14), the locking members pivot about fulcrums 118 against the bias of spring fingers 114 to move distal ends 104 and hooks 108 to an open condition for receiving the mating connector. When the mating connector is fully connected to connector 20, the locking members are released and hook portions 108 can snap behind hook portions 110 (FIG. 19) on latch arms 112 of the mating connector.

Figure 16:
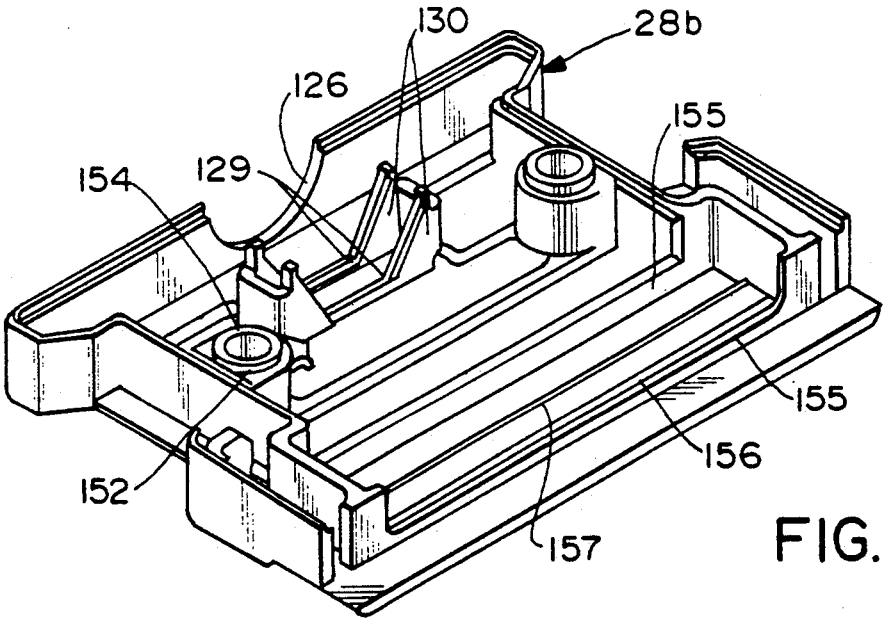
FIG. 16 is a perspective view of the underside of the top backshell half shown in FIG. 8.

Referring to FIG. 16 in conjunction with FIG. 12, strain relief means are provided for clamping backshell halves 28*a* and 28*b* onto multi-conductor cable 34 as seen in FIG. 10. More particularly, FIG. 16 shows the underside of upper backshell half 28*b*. Like lower backshell half 28*a*, a semi-circular notch or recess 126 is provided in the upper backshell half to combine with semi-circular recess 84 in the lower backshell half to receive the multi-conductor cable. The lower backshell half is provided with three spaced, hexagonal ribs 128 (FIG. 12). The upper backshell half is provided with two spaced ribs 130 (FIG. 16). These ribs define troughs within which the multi-conductor cable is positioned when the backshell halves are assembled (FIGS. 8 and 10). As seen in FIG. 10, upper ribs 130 are located between lower ribs 128 to clamp onto cable 34 and provide strain relief therefor. This can be seen by the indentation of the ribs in jacket 36 of the cable in FIG. 10. When the backshell halves are assembled, the ribs create a generally hexagonal opening. The hexagonal shape is preferred over circular ribs because the hexagonal shape includes corners 129 into which the insulated outer jacket 36 of cable 34 is moved when the cable is deformed during clamping.

Figure 8A:
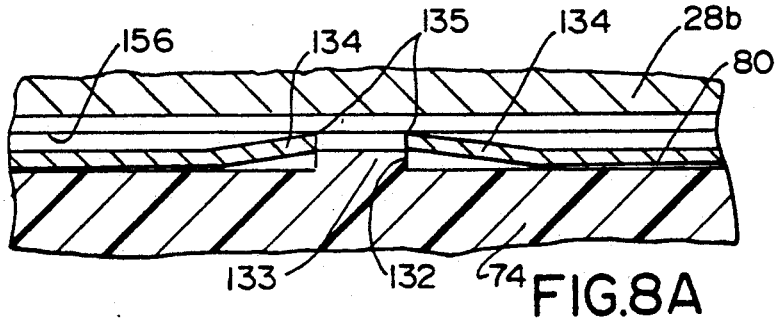
FIG. 8A is an enlarged fragmented section taken generally along line 8A—8A of FIG. 8.

Referring to FIG. 8A in conjunction with FIG. 8, upper and lower flanges 80 of shield 76 of base assembly 26 are provided with a plurality of apertures 132 stamped out of the sheet metal material of the shield for receiving latch projections 133 on dielectric housing 74 to assemble the shield to the housing. A pair of spring fingers 134 are formed from the metal at opposite sides of the apertures and are bent outwardly of flanges 80 to define sharp distal edges 135 (FIG. 8A). The apertures and spring fingers are formed in both the upper and lower flanges 80 of shield 76, although only the upper flange is visible in FIG. 8. The sharp distal edges of up-turned spring fingers 134 engage against rib 156 located on the inside of planar portions 136 of the backshell halves to complete the conductivity between shield 76 and the backshell assembly.

Another feature of connector assembly 20 is shown in FIGS. 12 and 16 and comprises means for securing and grounding a drain wire from cable 34. Specifically, as seen in FIG. 12, a groove 150 is provided in internally threaded boss 86 alongside wall 116. This groove is dimensioned for receiving a drain wire from the multi-conductor cable. Referring to FIG. 16, a circular rib 152 surrounds a hole 154 through which one of the screws 32 (FIG. 1) extends. This rib is effective to force the drain wire into groove 150 and securely hold the drain wire in grounding conductivity with the backshell assembly when the backshell halves are assembled.

A further feature of the invention is shown with reference to FIGS. 1 and 12. Specifically, both the upper and lower backshell halves include spaced, transversely extending walls 155 and generally parallel ribs 156 and 157 between the walls. The walls form a pocket for receiving the sub-assembly of the base assembly 26 and guide members **22*a* and 22*b* shown in FIG. 7 to secure the sub-assembly within the connector assembly. In addition to the purpose set forth above for rib 156**, the ribs provide support for the assembly and prevents bowing and possible failure of the sub-assembly during mating.

Figure 17:
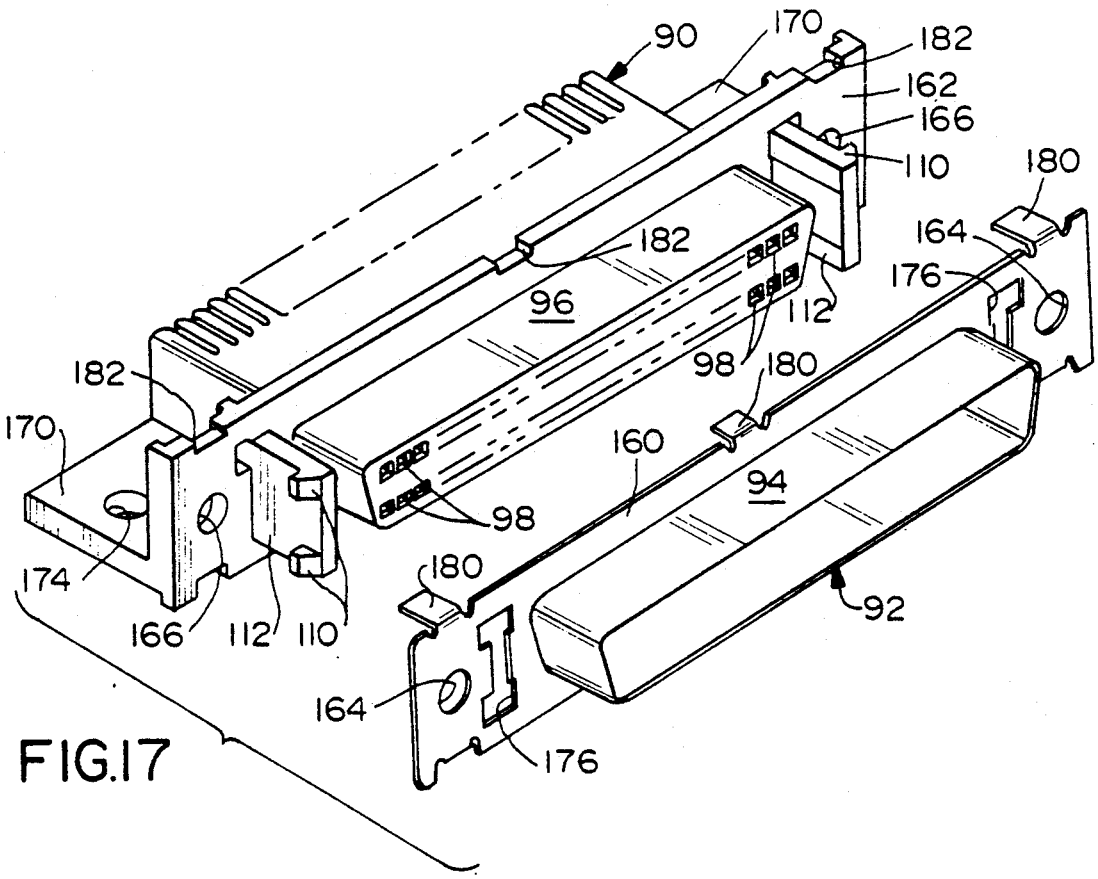
FIG. 17 is an exploded perspective view, on an enlarged scale, of the housing and shell of a complementary connector for mating with the connector of FIG. 9.

Referring to FIG. 17 in conjunction with FIG. 19, mating connector 18, including molded plastic housing 90 and metal shell 92, are shown in an exploded depiction. Housing 90 and shield 92 have D-shaped portions 96 and 94, respectively, for mating within hood portion 78 of shield 76 of connector assembly 20. Shield portion 94 defines a hood for surrounding housing portion 96 and provides shielding for the terminals therewithin. Portion 96 of housing 90 has two rows of apertures 98 within which are disposed female terminals for receiving pin portions 70 of the terminals of connector assembly 20. Whereas connector assembly 20 defines a connector plug assembly, mating connector 88 defines a receptacle connector assembly.

A peripheral flange 160 of shield 92 abuts a peripheral flange 162 of housing 90. Through apertures 164 in shield 92 are aligned with through apertures 166 in housing 90, for purposes described hereinafter. Peripheral flange 160 of the shield has a pair of elongated slots 176 for receiving latch arms 112 of the housing. In assembly, the latch arms are inserted through slots 176. For further permanent securing, a plurality of tabs 180 are provided on the top and bottom edges of flange 160 of the shield for positioning within notches 182 in the housing, whereby the tabs are bent around the backside of peripheral flange 162 to ensure tight securement of the shield to the housing. Mating connector 88 can be assembled to a printed circuit board by means of appropriate ground boardlock devices or clips (described hereinafter) projecting through apertures 174 in housing 90 to secure the connector to the printed circuit board. Still referring to FIG. 17 it should be understood that housing 90 is molded as a unitary component of plastic or like material, including latch arms 112.

Figure 18:
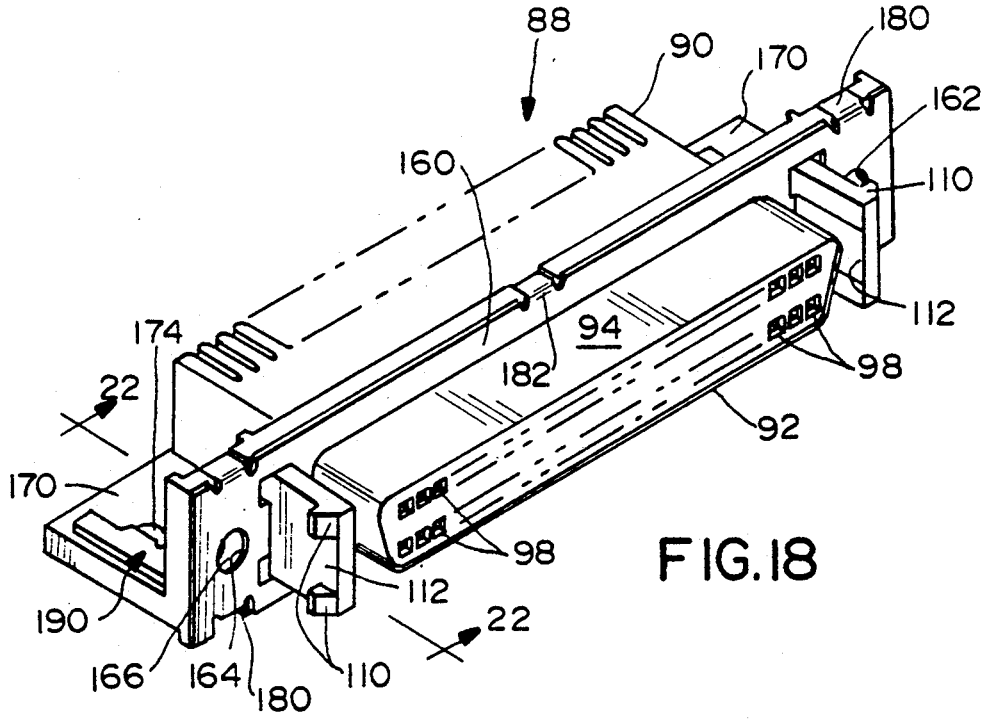
FIG. 18 is a perspective view of the complementary electrical connector with the shell and housing assembled.

FIG. 18 shows metal shell 92 assembled to molded plastic housing 90, with latch arms 112 of the housing projecting through slots 176 of the shell. In addition, it can be seen that tabs 180 have been bent over peripheral flange 162 of the housing within notches 182.

Figure 20:
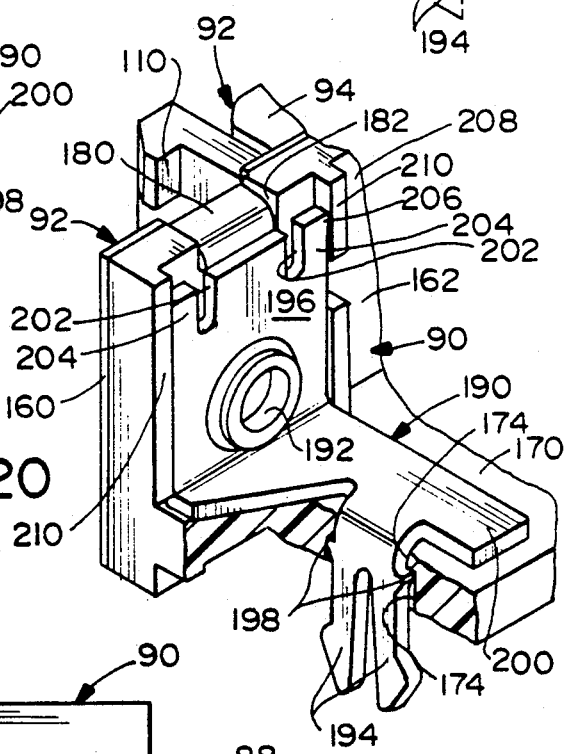
FIG. 20 is a fragmented perspective view, on an enlarged scale, of one of the boardlock ground clips of FIG. 19, secured to the housing.

Whereas FIG. 18 looks in the direction of the mating end of housing 90, FIG. 19 looks in the direction of the terminating end of the housing in conjunction with a pair of ground clips, generally designated 190. Still further, FIG. 20 shows one of the ground clips assembled to the housing, and FIG. 21 is a section through the connector assembly with the housing, shell and ground clip fully assembled.

Each ground clip 190 is fabricated of stamped and formed metal material and has a threaded hole 192 to receive a screw through apertures 164 and 166 (FIG. 17) in the shield and the housing, respectively. Each ground clip has a bifurcated boardlock portion 194 at one end, and an upwardly projecting flange 196 at an opposite end for positioning behind peripheral flange 162 of housing 90. The bifurcated boardlock portion includes barbs 198 for securement within aperture 174 in flange 170 of the molded dielectric housing. Each ground clip 190 also has a cantilevered flange portion 200 to resist rotation of the ground clip and reduce the pressure exerted on the plastic housing by locking barbs 198. Upwardly projecting flange 196 includes a pair of channels 202 projecting downward from its top surface to create a pair of resilient legs 204 having outwardly projecting tips 206. The rear 208 of housing 90 includes a pair of vertical ribs 210 projecting therefrom and spaced apart such that tips 206 of legs 204 contact the inner surface of the ribs in an interference fit when ground clip 190 is assembled to housing 90 in order to further secure the clip to the housing.

Figure 21:
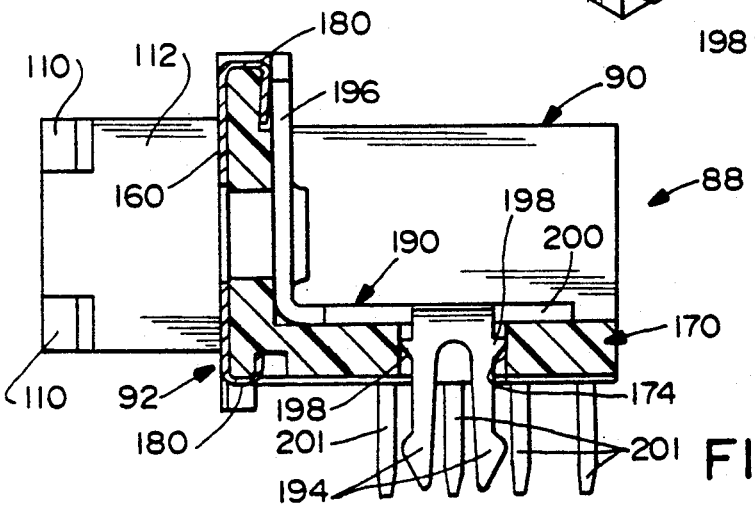
FIG. 21 is a vertical section, on an enlarged scale, taken generally along line 21—21 of FIG. 18.
Figure 24:
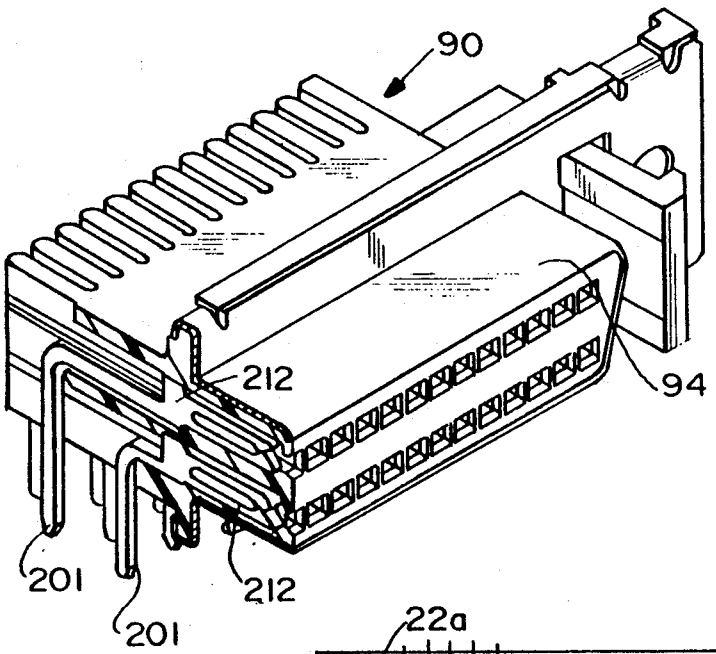
FIG. 24 is a vertical section, taken generally along line 24—24 of FIG. 19.

FIGS. 21 and 24 show that housing 90 includes "tuning fork" shaped terminals 212 having pins portions 201 for insertion into holes in an appropriate printed circuit board, not shown.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly for terminating a multi-conductor cable, comprising:

a pair of conductor guide members which are elongated and each having a plurality of channels for positioning the conductors of the multi-conductor cable whereby the conductors can be trimmed along on edge of the guide member;

the guide members being profiled such that the channels in one guide member are offset relative to the channels in the other guide member when the guide members are juxtaposed in their elongated direction;

a cover member profiled for engagement with the conductor guide member with a portion of the cover member covering exposed ends of the trimmed conductors; and a base assembly mounting a plurality of terminals, the base assembly being profiled for aligning the terminals for termination to respective ones of the conductors when the base assembly is assembled with the conductor guide member and cover member.

2. The connector assembly of claim 1 wherein said cover member is sandwiched between the conductor guide member and the base assembly and includes a plurality of apertures through which the terminals project for termination to the conductors.

3. The connector assembly of claim 1 wherein said channels open on a mating face of the conductor guide member, and the cover member has a complementary mating face for retaining the conductors in the open channel.

4. The connector assembly of claim 1, including first complementary interengaging latch means between the conductor guide member and the cover member for assembling the cover member to the conductor guide member, and second complementary interengaging latch means between the cover member and the base member for assembling the base member to the assembled cover member and conductor guide member.

5. The connector assembly of claim 1, including a plurality of insulation displacement terminals mounted on the base assembly, the terminals having pin portions projecting outwardly in a row transverse to the conductors and insulation displacement portions projecting inwardly for termination to the conductors, the insulation displacement portions of alternating ones of the terminals being offset on opposite sides of a plane defined by the row of pin portions.

6. The connector assembly of claim 1 wherein said pair of conductor guide members have recess means defining a longitudinal slot therebetween, when the guide members are in longitudinal juxtaposition, for receiving discrete conductors of the multi-conductor cable in such a manner that the conductors can be positioned seriatim in alternating ones of the channels in the respective guide members on opposite sides of the longitudinal slot.

7. The connector assembly of claim 6 wherein said cover member has rows of said apertures extending longitudinally on opposite sides of said longitudinal slot.

8. The connector assembly of claim 6 wherein said cover member has portions on opposite sides of said longitudinal slot for covering exposed ends of trimmed conductors positioned in both of said pair of conductor guide members.

9. The connector assembly of claim 6, including comb means projecting from at least one of the conductor guide members into the slot for locating the discrete conductors in alignment with the channels.

10. A shielded electrical connector assembly for terminating a multi-conductor cable, comprising:

a dielectric housing mounting a plurality of terminals;

a metal shield about a portion of the housing;

latch means between the housing and the shield, including an aperture in the shield and a latch projection on the housing for latching in the aperture, the aperture having at least one abrupt edge projecting outwardly from the shield, the shield fabricated of stamped and formed metal material with the aperture being stamped and the abrupt edge being therefrom said abrupt edge provided by a sharp distal edge of a cantilevered spring finger formed from the metal at one side of the aperture; and a conductive backshell about at least a portion of the shield which includes said latch means, the backshell being profiled to engage the abrupt edge of said aperture to enhance conductivity between the shield and the backshell.

11. The shielded electrical connector assembly of claim 10, including a pair of said spring fingers, one at each of two opposite sides of the aperture.

12. The shielded electrical connector assembly of claim 10 wherein said backshell comprises a pair of mating parts having strain relief means therebetween for clamping onto the cable when the parts are mated, the strain relief means comprising at least a pair of ribs on one of the backshell parts for clamping onto one side of the cable and at least one rib on the other backshell part for clamping onto an opposite side of the cable, the one rib being located between the pair of ribs.

13. A shielded electrical connector assembly for terminating a multi-conductor cable, comprising:

a dielectric housing mounting a plurality of terminals;

a metal shield about a portion of the housing;

latch means between the housing and the shield, including an aperture in the shield and a latch projection on the housing for latching in the aperture, the aperture having at least one abrupt edge projecting outwardly from the shield;

a conductive backshell about at least a portion of the shield which includes said latch means, the backshell being profiled to engage the abrupt edge of said aperture to enhance conductivity between the shield and the backshell; and wherein said cable is of the type having a drain conductor, and said backshell comprises a pair of mating halves, one half including a groove for receiving the drain conductor and the other half having a rib for forcing the drain conductor into the groove when the halves are assembled.

14. A shielded electrical connector assembly for terminating a multi-conductor cable, comprising:

a dielectric housing mounting a plurality of terminals;

a metal shield about a portion of the housing;

latch means between the housing and the shield, including an aperture in the shield and a latch projection on the housing for latching in the aperture, the aperture having at least one abrupt edge projecting outwardly from the shield;

a conductive backshell about at least a portion of the shield which includes said latch means, the backshell being profiled to engage the abrupt edge of said aperture to enhance conductivity between the shield and the backshell and;

wherein said backshell includes a lock means for engaging an appropriate mating connector, the lock means including a locking member of elastic material having a proximal end engaging the backshell, a distal end for locking engagement with the mating connector and a fulcrum portion intermediate the ends, the fulcrum portion being rounded and the backshell having a rounded socket within which the fulcrum portion is disposed.

15. The shielded electrical connector assembly of claim 14 wherein said locking member is fabricated of formed metal material, the fulcrum portion is generally cylindrical and the rounded socket is formed by generally cylindrical walls of the backshell.

16. An electrical connector assembly for terminating a multi-conductor cable, comprising:

a pair of conductor guide members which are elongated and each having a plurality of channels for positioning the conductors of the multi-conductor cable whereby the conductors can be trimmed along an edge of the guide member;

the guide members being profiled such that the channels in guide member are offset relative to the channels in the other guide member when the guide members are juxtaposed in their elongated direction; and a base assembly mounting a plurality of terminals, the base assembly being profiled for aligning the terminals for termination to respective conductors when the base assembly is assembled to the conductor guide member, and the base assembly includes a portion thereof covering exposed ends of the trimmed conductors.

17. The connector assembly of claim 17 wherein said channels open on a mating face of the conductor guide member, and the cover member has a complementary mating face for retaining the conductors in the open channel.

18. The connector assembly of claim 17, including a plurality of insulation displacement terminals mounted on the base assembly, the terminals having pin portions projecting outwardly in a row transverse to the conductors and insulation displacement portions projecting inwardly for termination to the conductors, the insulation displacement portions of alternating ones of the terminals being offset on opposite sides of a plane defined by the row of pin portions.

19. The connector assembly of claim 16 wherein said pair of conductor guide members have recess means defining a longitudinal slot therebetween, when the guide members are in longitudinal juxtaposition, for receiving discrete conductors of the multi-conductor cable in such a manner that the conductors can be positioned seriatim in alternating ones of the channels in the respective guide members on opposite sides of the longitudinal slot.

20. The connector assembly of claim 1 or 24, wherein said channels include retaining means to maintain the individual conductors within the channels.

21. An electrical connector assembly for terminating a multi-conductor cable, comprising:

a pair of elongated conductor guide members each having a plurality of channels for positioning the conductors of the multi-conductor cable for termination with a plurality of terminals, the guide members being profiled such that the channels in one guide member are offset relative to the channels in the other guide member when the guide members are juxtaposed in their elongated direction; and a base assembly mounting the plurality of terminals, the base assembly being profiled for aligning the terminals for termination to respective ones of the conductors when the base assembly is connected to the juxtaposed guide members.

22. The connector assembly of claim 21 wherein said pair of conductor guide members are identical and hermaphroditic.

23. The connector assembly of claim 19, including comb means projecting from at least one of the conductor guide members into the slot for locating the discrete conductors in alignment with the channels.

24. The connector assembly of claim 9 or 8 wherein said comb means includes retaining means to maintain the individual conductors within the comb means.

* * * * *